US010470632B2

(12) United States Patent
Foenss

(10) Patent No.: US 10,470,632 B2
(45) Date of Patent: Nov. 12, 2019

(54) SUCTION-TYPE CLEANER WITH DEDUSTING CONTROL FOR THE FILTER OR FILTERS

(71) Applicant: Nilfisk-Advance A/S, Brøndby (DK)

(72) Inventor: Anders Foenss, Gistrup (DK)

(73) Assignee: NILFISK A/S, Brondby (DK)

( * ) Notice: Subject to any disclaimer, the term of this patent is extended or adjusted under 35 U.S.C. 154(b) by 846 days.

(21) Appl. No.: 14/786,682

(22) PCT Filed: Mar. 14, 2014

(86) PCT No.: PCT/EP2014/000010
§ 371 (c)(1),
(2) Date: Jan. 27, 2016

(87) PCT Pub. No.: WO2014/173481
PCT Pub. Date: Oct. 30, 2014

(65) Prior Publication Data

US 2016/0150932 A1 Jun. 2, 2016

(30) Foreign Application Priority Data

Apr. 25, 2013 (DE) ..... 10 2013 007 183

(51) Int. Cl.
*A47L 9/20* (2006.01)
*A47L 5/36* (2006.01)
*A47L 9/28* (2006.01)

(52) U.S. Cl.
CPC *A47L 9/20* (2013.01); *A47L 5/36* (2013.01); *A47L 5/365* (2013.01); *A47L 9/2857* (2013.01)

(58) Field of Classification Search
CPC . A47L 9/20; A47L 5/36; A47L 9/2857; A47L 5/365
See application file for complete search history.

(56) References Cited

U.S. PATENT DOCUMENTS 5,347,809 A 9/1994 Moeckel et al.
6,416,295 B1 * 7/2002 Nagai ..... F04F 5/44 417/187

(Continued)

FOREIGN PATENT DOCUMENTS

DE 10101219 A1 7/2002
DE 102008047047 A1 4/2010

(Continued)

*Primary Examiner* — Michael D Jennings
(74) *Attorney, Agent, or Firm* — Browdy and Neimark, PLLC

(57) ABSTRACT

A method for operating a suction-type cleaner, in which, in a manner controlled in the filter dedusting position by an electromagnetically actuated switchover valve arrangement (19, 20, 21), at least one filter (9), through which the dirt-laden air flow passes, is dedusted in the opposite direction to said air flow, and the dirt-laden suction air from the dirt-collecting container (1) firstly passes through the at least one filter (9) which is adjoined, in the flow direction, by a suction chamber (12), which is adjoined downstream by an intermediate chamber (26) which is arranged on the suction side of the turbine (30), and a pressure chamber (34) is arranged downstream of the turbine (30), wherein, in order to reduce the actuating force of the switchover valve arrangement (19, 20, 21) in the dedusting position of the suction-type cleaner, the pressure between the pressure chamber (34) and the intermediate chamber (26) is equalized.

7 Claims, 3 Drawing Sheets

(56) References Cited

U.S. PATENT DOCUMENTS

| | | | | |
|---|---|---|---|---|
| 2005/0011036 | A1 | 1/2005 | McCutchen | |
| 2012/0318133 | A1* | 12/2012 | Truglia | F01B 17/02 91/55 |

FOREIGN PATENT DOCUMENTS

| | | | |
|---|---|---|---|
| DE | 202010012821 | U1 | 12/2010 |
| DE | 202006020948 | U1 | 3/2011 |
| EP | 1656872 | A2 | 5/2006 |

* cited by examiner

SUCTION-TYPE CLEANER WITH DEDUSTING CONTROL FOR THE FILTER OR FILTERS

The invention relates to a method for operating a suction-type cleaner having a dedusting control for the filter or filters in accordance with the preamble to patent claim 1. Such a dedusting control became known with the subject matter of DE 101 01 219 A1, in which, however, a suction-type cleaner is provided with a divided filter and two valves for controlling the dedusting of the filter.

In accordance with this prior art, a discrete reversing valve is allocated to each filter (filter half) to be dedusted.

Each reversing valve was actuated electromagnetically and comprised a solenoid that actuates a valve rod on which were arranged two valve plates that were arranged at a distance from one another.

Thus, the working position was in the one lifting position, which means that soiled air is flowing through both filter halves.

In contrast, if a solenoid was actuated, this lifted the valve rod and brought the reversing valve into a second closed condition. In this dedusting position, the compressed air of the turbine is conducted to flow through the filter to be dedusted in the direction opposing the direction of suction so that the filter is purged with high pressure and the dirt particles thereby blown out of the filter pores drop into the dirt container.

Figure 2:
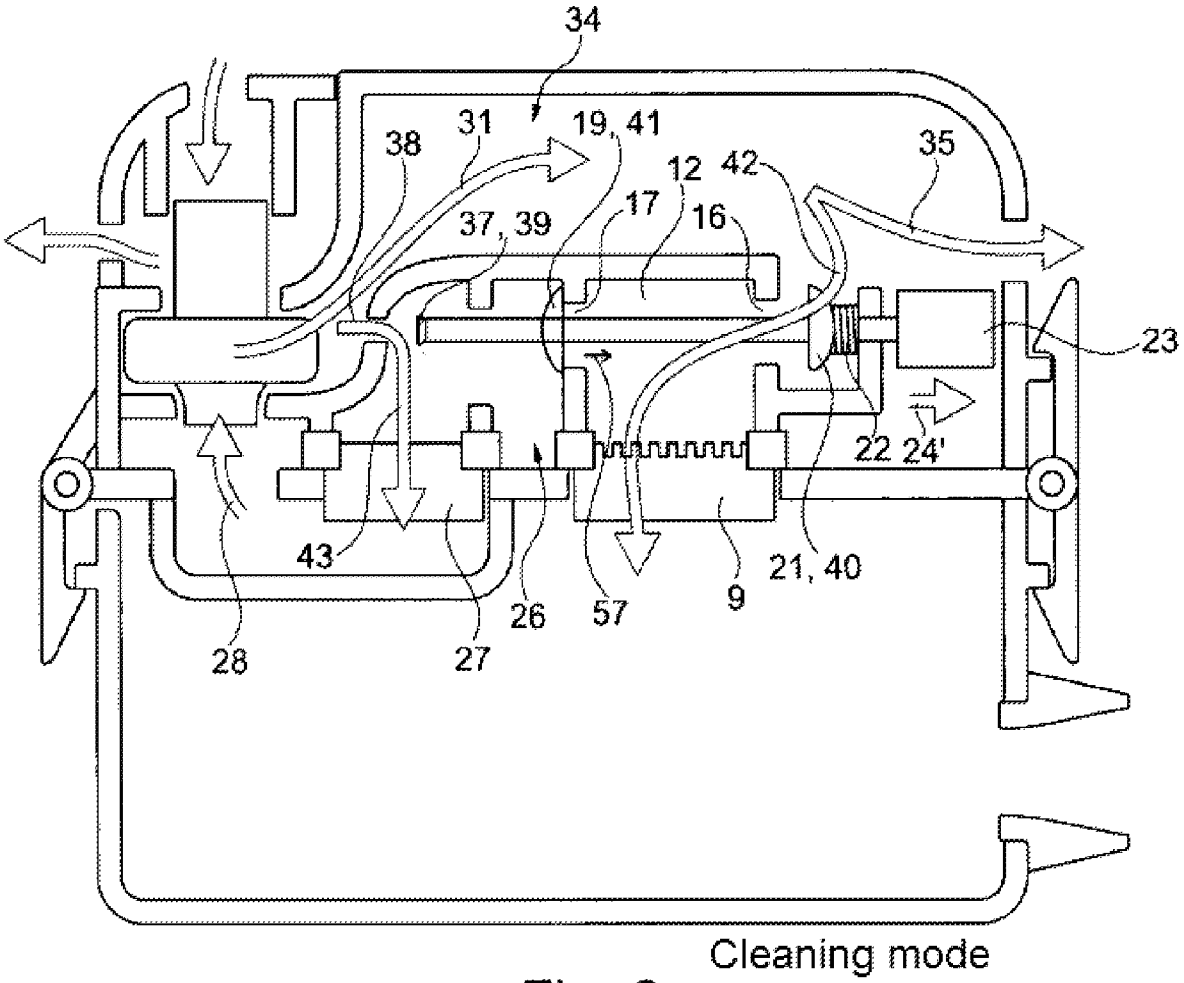

It is a drawback of this arrangement that, in the dedusting position, as is shown for instance in FIG. 2 of DE 101 01 219 A1, the solenoid lifts the upper valve plate 30a with full lifting force and must press the lower valve plate 31a against the valve opening that is now to be closed.

Since, in accordance with the arrows labeled 31a in FIG. 2 of DE 101 01 219 A1, a negative pressure also acts on the valve plate 31a in a disadvantageous manner in the context of an opening movement, the solenoid must be supplied with a high current to counteract the opening movement of the valve plate 31a that occurs due to the suction pressure.

This results in high current consumption in the solenoid and consequently in greater energy consumption by the suction-type cleaner overall.

FIG. 5 in US 2005/0011 036 A1 discloses a valve rod 22 on which are arranged two reversing valves 65, 72 spaced apart from one another.

In this case, as well, there is the drawback that because of the effect of suction pressure on the closed valve plate of the drive motor, additional force must be applied for actuating the valve rod in order to hold the closed valve in the closed position against the suction pressure acting in the opening direction.

Another suction-type cleaner with a dedusting device became known with the subject matter of U.S. Pat. No. 5,347,809 A1, in which, although the two valve plates differ in size, overall for lifting the valve rod a pneumatic device is used that must be actuated with a complex electromagnetic control under the force of a compression spring. In this publication, the primary problem is not that the energy consumption of the control for actuating the valve rod must be kept low. Instead, with this invention the issue is that beneficial dedusting of an automobile filter is to occur using pre-heated gases.

Therefore, proceeding from DE 101 01 219 A1, the underlying object of the invention is to refine a dedusting control for one or a plurality of filters of a suction-type cleaner such that the energy consumption of the solenoid actuating the valve rod(s) or of a comparable control device is significantly reduced and open and closed positions of the reversing valve are provided that are secured against fluttering of the valve device.

For attaining this stated object, the invention is characterized by the technical teaching of claim 1.

A feature of the invention is that in a manner known per se the two valve plates seated on the same valve rod each close the through-opening of a suction chamber, and that an intermediate chamber that is arranged upstream of the primary filter and through which suction air flows is connected to the suction chamber in an air-conducting manner in a locked connection, and that a valve arrangement that in the dedusting position equalizes the pressure between pressure chamber and the intermediate chamber is arranged in the region of this intermediate chamber.

Using the inventively provided pressure equalization between the pressure chamber and the intermediate chamber ensures there is no detrimental negative pressure in the cleaning position acting on the valve plate in the opening direction and against the solenoid, because the intermediate chamber is deaerated and the negative pressure is removed from this intermediate chamber.

The invention describes as a preferred exemplary embodiment an electromagnetically actuated reversing valve, the actuating rod of which cooperates with the valve arrangement to minimize the actuating force on the actuating rod. However, the invention is not limited thereto. Instead of an electromagnetically actuated reversing valve having an actuating rod, all other known drive systems may be optimized with the invention in that their actuating force (and thus also current consumption) is minimized. According to the teaching of the invention, this always occurs in that the drive or actuating system of the reversing valve arrangement cooperates with the valve system of the suction-type cleaner such that the negative pressure produced in the filter system is used to minimize the actuating force of the reversing valve arrangement. Therefore the negative pressure produced in the filter system always has a unloading effect on the drive system of the reversing valve device and minimizes the latter's drive power Minimizing the drive power for a solenoid shall be understood to be only an example and does not limit the protective scope of the invention.

Thus there is the advantage that the solenoid, which is mentioned merely as an example, does not also have to overcome the opening pressure acting on the valve plate in the intermediate chamber, since, due to the deaeration of the intermediate chamber, the lifting force of the solenoid no longer also has to overcome this opening pressure.

Thus the current requirement of the solenoid or another electromagnetic, electropneumatic, or mechanical control device or a similarly acting drive device is significantly reduced.

The additional advantage is comprised in that, despite a lower current requirement and a lower drive power for the solenoid, fluttering of the two valve plates on the valve rod is reliably prevented in the valve device.

In the dedusting position, the intermediate chamber is connected air-tight to the pressure chamber. Consequently in the opening position the intermediate chamber connected downstream to the suction chamber is deaerated and thus a negative pressure is removed from this intermediate chamber.

This is attained using a third valve that admits the compressed air into the intermediate chamber and thus eliminates the negative pressure prevailing there that would oppose the lifting movement of the solenoid.

There are different embodiments for the arrangement of the third valve arrangement for deaerating the intermediate chamber in the cleaning mode.

In a first embodiment it is provided that the third valve is arranged on the valve rod together with the two other valve plates so that if the valve rod for the two other valve plates is actuated the third valve that causes the deaeration of the intermediate chamber by the pressure chamber is also actuated at the same time.

This is a particularly simple embodiment because the third valve arrangement is always necessarily coupled to the two other valve rods and their movement because the third valve is seated on the same valve rod as the other valves.

In this case it is preferred that the cross-section of the third valve is smaller than the cross-section of the valve plate that ensures there is a closing movement at the inlet between the pressure chamber and the suction chamber.

That is, if the cross-section were not smaller, then the aforesaid valve plate could not reliably close.

Therefore for attaining the object it is necessary that the valve cross-section of the third valve is smaller than the valve cross-section of the one valve plate that is arranged between the pressure chamber and the suction chamber.

In a second embodiment of the present invention it is demonstrated that it is not necessary to attaining the object to arrange the third valve that has the valve plate embodied with a smaller cross-section on the valve rod for actuating the two other valve plates. This third valve may be arranged entirely independently in the connection region between the pressure chamber and the intermediate chamber and may for instance pass through the upper section of the pressure chamber or the upper section of the cleaning unit so that it opens supported when required and corresponding to the required cleaning mode when the cleaning mode is turned on in order thus to produce an air-tight connection between the pressure chamber and the intermediate chamber.

In a third embodiment it may be provided that the deaeration valve is arranged as a spring-loaded return valve that does not open against the force of a spring until, in the cleaning position, the negative pressure in the intermediate chamber increases sharply and at the same time the air outflow pressure also increases sharply at the same time in the opposing pressure chamber.

The difference in pressure then leads to the opening of the return valve that is held in the closed position in a spring-loaded manner.

The subject matter of the present invention results not only from the subject-matter of the individual patent claims, but also from the combination of the individual patent claims with one another.

All of the information and features disclosed in the documents, including the abstract, especially the physical embodiment depicted in the drawings, are claimed as essential to the invention if they are novel, individually or in combination, relative to the prior art.

The invention shall be described in greater detail in the following using drawings depicting only one embodiment. Additional features and advantages essential to the invention proceed from the drawings and their description.

Figure 1:
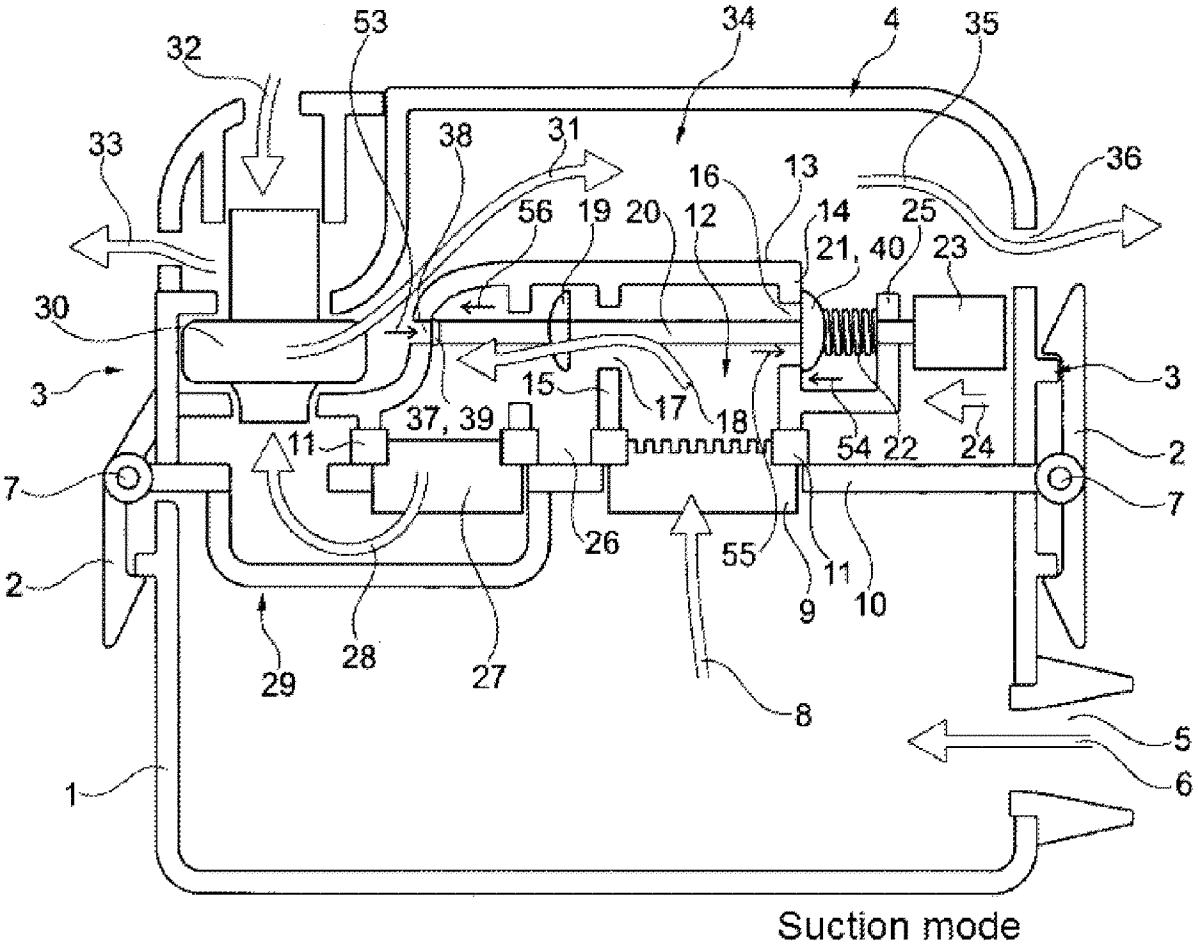
Figure 3:
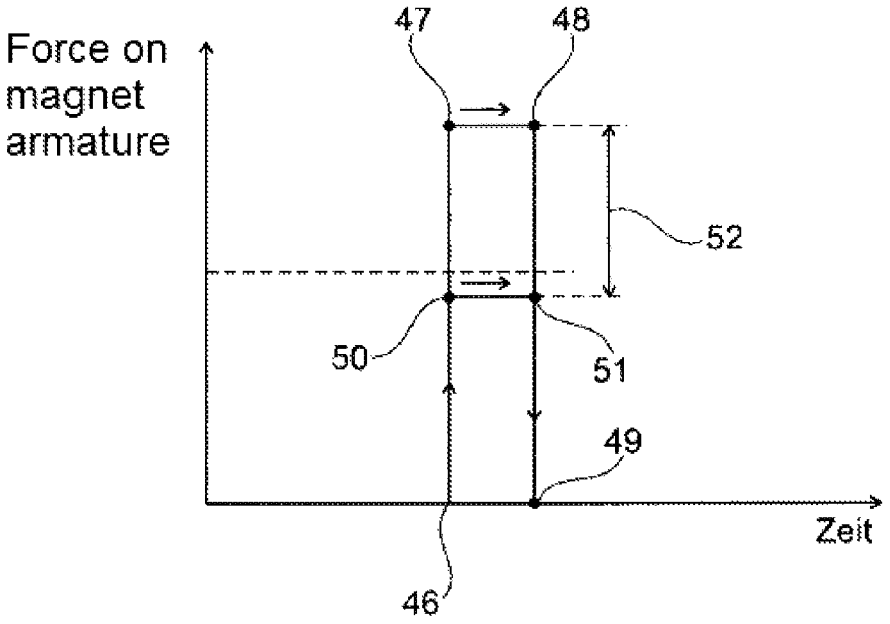

FIG. 1: is a diagram of a section through a suction-type cleaner having the arrangement of the filter dedusting of a flat filter in the suction mode;

FIG. 2: is the same depiction as FIG. 1, but in cleaning mode;

FIG. 3: is a diagram comparing the force on the magnet armature over time when switching from suction mode to cleaning mode.

FIG. 1 depicts a suction-type cleaner in general that comprises a primary filter 27 and an upstream pre-filter 9. But the invention is not limited thereto. It may also have two primary filters 27, one dedusting unit then being allocated to each, as is depicted in the form of the cleaning unit 3 in FIG. 1.

Consequently the dedusting arrangement in accordance with FIGS. 1 and 2 of the invention may also be transferred to a dual filter arrangement in accordance with DE 101 01 219 A1.

The invention is thus not limited to dedusting a single primary filter 27.

In the exemplary embodiment depicted, the suction-type cleaner essentially comprises a container 1 that receives the dirt and that is detachably connected via lateral locks 2 to a cleaning unit 3 arranged there above. A cover unit 4 is detachably arranged on the cleaning unit 3.

The dirt-laden air flows in the direction of the arrow 6 via the inlet 5 into the interior of the container 1 and flows in the direction of the arrow 8 towards the bottom of the pre-filter 9, embodied as a flat filter, which is arranged below the cleaning unit 3 with a circumferential seal 11 in two side walls 14, 15 that are spaced apart from one another. Other types of filters, such as for instance a round filter, pleated filter, or the like, may also be used instead of a flat filter.

Once it has flowed through the pre-filter 9, the air flows in the direction of the arrow 18 into the suction chamber 12, which is formed in the cleaning unit 3 by the two side walls 14, 15 that are spaced apart from one another, wherein the two side walls 14, 15 each have an opening 16, 17 that may be selectively closed by a valve plate 19, 21 when the suction-type cleaner is switched from suction mode in accordance with to FIG. 1 to cleaning mode in accordance with FIG. 2.

In the depicted suction mode in accordance with FIG. 1, the left opening 17 in the side wall 15 is consequently open because the valve plate 19 seated securely on the valve rod 20 is raised from the opening 17, while the valve plate 21 that closes the opening 16 is held in the closed position by a spring 22 so that the opening 16 is thus closed in an air-tight manner. The solenoid 23 has not yet been actuated, because the closing force on the valve plate 21 is applied solely by the spring 22 in the direction of the arrow 24.

The force of the spring 22 is supported in that a negative pressure prevails in the suction chamber 12 compared to the pressure chamber 34 disposed thereabove, so that even with the effect of the positive pressure the valve plate 21 is held in its closed position in the opening 16, and supports the force of the spring 22. At the same time, however, also given this negative pressure that is exerted on the valve plate 21 and supports the spring 22, a third valve that has a valve plate 37 and that is also seated on the valve rod 20 is pressed against an associated outlet 38 so that this outlet 38 is closed in the suction mode.

In the depicted suction mode, therefore, the suction air flowing out of the suction chamber 12 from above in the direction of the arrow 18 through the opening 17 flows through the primary filter 27, which is depicted as a non-dedustable filter. In the exemplary embodiment depicted, therefore, only the pre-filter 9 is dedusted with the inventive dedusting device.

The suction air consequently flows through the primary filter 27 and leaves the latter in the direction of the arrow 28 in that the suction air flows through a clean air chamber 29 that is arranged on the intake side of the turbine 30. The turbine takes this air in the direction of the arrow 28, compresses this air, and drives this air under high pressure in the direction of the arrow 31 into the pressure chamber 34 arranged thereabove.

The pressure chamber is separated from the cleaning unit 3 by the upper section 13.

The outlet 38, still closed by the valve plate 37, is arranged in the upper section 13. The two filters 9, 27 are themselves arranged in the through regions of a base plate 10 that embodies the bottom section of the cleaning unit 3.

The drive motor of the turbine 30 is cooled by incoming cooling air 32 that is discharged as exhaust 33.

The solenoid 23 is retained in a retaining element 25 on the side wall 14 of the upper section 13.

The air flowing into the pressure chamber 34 in the direction of the arrow 31 exits an outlet 36 in the direction of the arrow 35 in the region of the cover unit 4.

The intermediate chamber 26 to be deaerated with the third valve plate 37 is formed by the side wall 15, which is closed when needed by the valve plate 19 and by the upper section 13 of the cleaning unit 3. The intermediate chamber 26 is disposed (upstream) in front of the primary filter 27 and after the pre-filter 9.

The intermediate chamber 26 is closed air-tight to the bottom by a wall of the base plate 10.

In the cleaning mode, the solenoid 23 is actuated in the direction of the arrow 24' into its open position and current runs through it, wherein it must overcome the force of the spring 22 in order to displace the valve rod 20 in the direction of the arrow 24' into the displaced position.

In this case, the negative pressure prevailing in the intermediate chamber 26 would ensure that the negative pressure also acts on the valve plate 19 and the latter attempts to move from its valve seat at the opening 17. The solenoid 23 must be embodied strong enough for this, because it must overcome the force of the spring 22 and it must also additionally overcome the opening force that acts on the valve plate 19.

For this reason solenoids 23 having relatively high current requirements had to be used in order to prevent the valve rod 20 from fluttering in an undesired manner and thus to prevent the valve plate 19 from lifting abruptly from the opening 17.

This is where the invention comes in; it provides that in the cleaning position depicted in FIG. 2 a deaeration opening, specifically the outlet 38 in the region between the pressure chamber 34 and the intermediate chamber 26 is simultaneously released so that compressed air flows into the intermediate chamber 26 in the direction of the arrow 43 from the pressure chamber 34 and there removes the undesired negative pressure from the valve plate 19 that is urging it from its seat at the opening 17.

Thus it is now no longer necessary for the solenoid 23 to have strong closing force in the direction of the arrow 24' because the pull-off force or the opening force on the valve plate 19 is provided by aerating the intermediate chamber 26. It is preferred when the cross-section 39 of the valve plate 37 of the third valve is embodied smaller than the air-active cross-section of the valve plate 19 so that an opening force that acts on the valve plate 27 in FIG. 1 in the suction mode does not lead to the outlet 38 opening.

The cross-section 39 of the valve plate 37 should be significantly smaller than the cross-section 40 of the valve plate 21.

However, it should also be large enough that appreciable deaeration of the air from the pressure chamber 34 occurs in the form of the air flow 43 for the intermediate chamber 26 in order to remove therefrom the detrimental negative pressure that acts in the opening direction on the valve plate 19. Thus the intermediate chamber 26 is deaerated in the cleaning mode.

Thus that a certain circulatory flow is enabled in the direction of the arrow 31 by the air flow leaving the turbine 30 because a sub-air flow 43 is diverted from this air flow. The turbine thus runs at least in part in a circular air flow.

At the same time, the air flow leaving the turbine in the direction of the arrow 31 leads to the dedusting air flow 42 depicted in FIG. 2, some of which leaves the outlet 36, but most of which flows abruptly as a dedusting air flow 42 from the opposing side through the pre-filter 9 and cleans the latter in pulses. The dedusting air flow 42 is maintained only until the pressure in the container 1 has equalized.

It is preferred when the cross-section 41 of the valve plate 19 is about the same size as the cross-section 40 of the valve plate 21.

The opposing forces are depicted in FIG. 1. In the suction mode, an opening force 53 from the pressure chamber 34 acts on the valve plate 37 that has a smaller cross-section 39 and that is therefore pressed against the valve seat in the opening 38 with a higher closing force 56.

At the same time, the spring 22 works on the valve rod in the closing direction with a closing force 54 and thus holds the valve plate 21 in its closed position, although a smaller opening force 55 from the third valve plate 37 embodied with a smaller cross-section acts on the other side of the valve plate. This is reason that the cross-section of the valve plate 37 must be smaller than the cross-section of the valve plate 21.

In the cleaning position, the solenoid 23 works in the direction of the arrow 24', and when the valve plate 37 is opened the intermediate chamber 26 is aerated with the air flow 43 from the pressure chamber and thus removes the negative pressure from the valve plate 19.

Thus the closing force 57 on the valve plate 19 is increased significantly because there is no negative pressure in the intermediate chamber 26, and, compared to the prior art, the solenoid 23 no longer has to apply such a strong lifting force because the lifting force has to overcome only the resistance of the spring 22. Thus the solenoid may be embodied with lower electrical power and achieves the same actuating force as the solenoids belonging to the prior art.

FIG. 2 depicts the advantageous effect of the invention.

Provided on the X-axis is the force of the magnet armature of the solenoid 23, which corresponds approximately to the current consumption of the solenoid, while time is given on the Y-axis.

The cleaning cycle begins at position 46, wherein the solenoid is actuated abruptly in the direction of the arrow 24'.

If there is now no deaeration of the intermediate chamber 26, the magnet armature would need a force up to position 47 in order to then undertake the dedusting in this hold position up to position 48. Once the current on the solenoid 23 was turned off, the curve would then run from position 48 to position 49.

In contrast, if the intermediate chamber 26 is aerated, it is only necessary to apply solenoid power from position 46 to position 50, and the dedusting occurs from position 50 to position 51 with significantly less force from the solenoid and terminates at position 49.

The difference between the two positions 50, 47 is the inventive force savings 52 on the solenoid, which force saving is attained using the inventive aeration of the intermediate chamber 26 in the cleaning mode.

Using the arrangement of the third valve, stable closing and opening positions for the valve device are attained and fluttering of the valve device, as is known in the prior art, may thus be reliably prevented.

KEY TO DRAWINGS

1 Container
2 Lock
3 Cleaning unit
4 Cover unit
5 Inlet
6 Direction of arrow
7 Pivot axis
8 Direction of arrow
9 Pre-filter
10 Base plate (of 3)
11 Seal (of 9)
12 Suction chamber
13 Upper section
14 Side wall
15 Side wall
16 Opening (in 15)
17 Opening (in 15)
18 Direction of arrow
19 Valve plate (left)
20 Valve rod
21 Valve plate (right)
22 Spring
23 Solenoid
24 Direction of arrow
25 Retaining element
26 Intermediate chamber
27 Primary filter
28 Direction of arrow
29 Clean air chamber
30 Turbine
31 Direction of arrow
32 Cooling air (in)
33 Exhaust
34 Pressure chamber
35 Direction of arrow
36 Outlet
37 Valve plate
38 Outlet
39 Cross-section (of 37)
40 Cross-section (of 21)
41 Cross-section (of 19)
42 Dedusting air flow
43 Air flow
44
45
46 Position
47 Position
48 Position
49 Position
50 Position
51 Position
52 Force savings
53 Opening force (on 37)
54 Closing force (on 21)
55 Opening force (on 21)
56 Closing force (on 37)
57 Closing force (on 19)

The invention claimed is:

1. A suction-type cleaner having a filter dedusting control in which cleaner, in the dedusting position, at least one filter through which dirt-laden air flows is dedusted by reversing a direction of air flow through said at least one filter, and at least one first valve electromagnetically actuated via a solenoid or another reversing device that abruptly switches to the dedusting position is allocated to the at least one filter; and the suction air first flows out of a dirt collection container through the at least one filter to which is connected, in the flow direction, a suction chamber having at least two openings, and the two openings are selectively closable using the first valve, wherein connected downstream of the suction chamber is an intermediate chamber that is arranged on the suction side of a turbine, and a pressure chamber is arranged downstream of the turbine, wherein for reducing the actuating force of the first valve, in the dedusting position of the suction-type container, the pressure between the pressure chamber and the intermediate chamber is equalized by a second valve that admits compressed air produced by the turbine into the intermediate chamber and eliminates the negative pressure prevailing in the intermediate chamber that opposes the lifting movement the solenoid.

2. The suction-type cleaner in accordance with claim 1, wherein for aerating the intermediate chamber, a valve plate of the second valve may be actuated, together with the first valve, and may be acted upon by the same drive.

3. The suction-type cleaner in accordance with claim 1, wherein for aerating the intermediate chamber, a valve plate of the second is arranged on a valve rod for actuating the first valve.

4. The suction-type cleaner in accordance with claim 1, wherein for aerating the intermediate chamber, the second valve is actuated separately from a drive for the first valve.

5. The suction-type cleaner in accordance with claim 1, wherein for aerating the intermediate chamber, a cross-section of a valve plate of the second valve is smaller than a cross-section of a valve plate that causes a closing movement at an inlet between the pressure chamber and the suction chamber.

6. The suction-type cleaner in accordance with claim 1, wherein, with respect to the first valve, a cross-section of a valve plate is about the same size as a cross-section of a valve plate of the second valve.

7. The suction-type cleaner in accordance with claim 1, wherein the second valve is a spring-loaded return valve.

* * * * *